US005143049A

United States Patent [19]

Laing et al.

[11] Patent Number: 5,143,049

[45] Date of Patent: Sep. 1, 1992

[54] PUMP FOR SECONDARY CIRCULATION

[76] Inventors: Karsten A. Laing; Nikolaus J. Laing, both of 632 Marsat Ct., Chula Vista, Calif. 92011

[21] Appl. No.: 498,711

[22] Filed: Mar. 26, 1990

Related U.S. Application Data

[63] Continuation-in-part of Ser. No. 110,192, Oct. 19, 1987.

[51] Int. Cl.[5] ..... F24H 1/00

[52] U.S. Cl. ..... 126/362; 137/329.1; 137/565

[58] Field of Search ..... 137/563, 565, 329.1; 126/362; 237/19, 59

[56] References Cited

U.S. PATENT DOCUMENTS 3,096,021 7/1963 Lintvedt ..... 126/362
3,941,517 3/1976 Miyahara ..... 417/420
4,623,093 11/1986 Arndt ..... 237/19

*Primary Examiner*—Henry A. Bennet
*Attorney, Agent, or Firm*—Henri J. A. Charmasson

[57] ABSTRACT

In a plumbing installation wherein hot water is piped from a water heater or reservoir to a plurality of taps by a distribution conduit, an improved recirculation circuit of limited power consumption to continually pump small amounts of hot water from said conduit back into said reservoir which comprises a low power radial pump unprotected by a check valve against backflow, but having a rotary impeller with linear radial vanes leading to an annular output channel larger than necessary for maximum pumping throughput. The oversized annular channel and linear vanes limit the impact of any backflow upon the impeller and prevents its operating as a tubine as the pump is subjected to back pressure when a large amount of water is being drawn through the taps.

3 Claims, 2 Drawing Sheets

PUMP FOR SECONDARY CIRCULATION

PRIOR APPLICATION

This application is a continuation-in-part of copending application Serial Number 07/110,192 filed Oct. 19, 1987.

BACKGROUND OF THE INVENTION

This invention relates to hot water distribution systems and more specifically to a recirculation pump used to maintain a flow of hot water throughout the distribution system in order to provide instantaneous hot water at each tap. Since the recirculation system needs only to draw a small amount of hot water from the distribution unit in order to make hot water immediately available to the various taps along the distribution system, the recirculation can be achieved with a smaller gauge of pipe than those used to supply the taps and a low throughput pump. Therefore, a low throughput pump with approximately 10 watts of power could be used in the recirculation circuit. However, when a large amount of hot water is drawn through the taps, the recirculation pump is subject to a substantial drop in input pressure amounting to up to ten times the normal working pressure of the recirculation pump. If the pump is not protected by a check valve the resulting backflow causes the recirculation pump to act as a turbine rotating at a much higher speed than the normal rated speed of the pump. Due to the large calcium buildup which may be expected in hot water circuits, the recirculation pump should not use any shaft and bushing with narrow clearance which can seize under calcium deposits. It is preferable to use a pump with a free-tilting spherical rotor-impeller mounted on a small ball-bearing as the one disclosed in U.S. Pat. No. 3,803,432 Laing. This pump and other types with equivalent performance can be damaged by high speed spinning due to backflow. It thus becomes necessary to install a check valve in series with the recirculation circuit to protect the pump. This in turn requires increasing the power of the recirculation pump to 35 to 50 watts in order to overcome the resistance of the check valve This added power may increase the electric consumption between 200 to 300 kilowatt hours per year.

There is need for an improved recirculation unit which would allow for the elimination of the check valve while limiting the effect of any backflow on the low power recirculation pump.

SUMMARY OF THE INVENTION

The principal and secondary objects of the invention are to provide an improved, low power hot water recirculation pump which is immune to damage due to backflow caused by the drawing of large amounts of hot water through the distribution system.

It is also an object of the invention to limit the energy consumption of a hot water distribution system by providing instant hot water at each drawing tap while limiting the amount of power necessary to permanently circulate small amounts of hot water through the system.

These and other objects are achieved by means of an improved low-recirculation centrifugal pump which has an impeller with radially linear vanes leading to an oversized annular output channel which together limits the impact of any backflow upon the impeller.

BRIEF DESCRIPTION OF THE PREFERRED EMBODIMENT OF THE INVENTION

Figure 1:
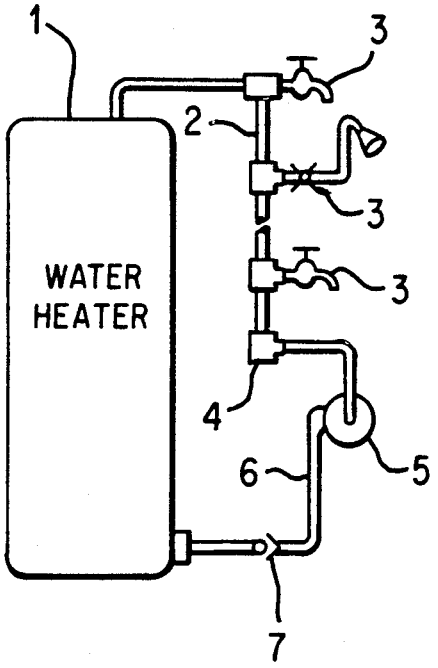
FIG. 1 PRIOR ART
FIG. 1 illustrates a water heater distribution and recirculation system of the prior art.
Figure 2:
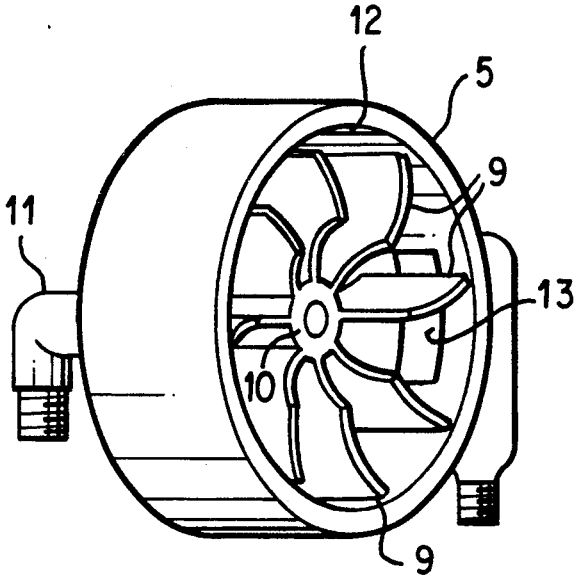
FIG. 2 PRIOR ART
FIG. 2 is a perspective view of the rotary impeller and output port of a conventional centrifugal pump.
Figure 3:
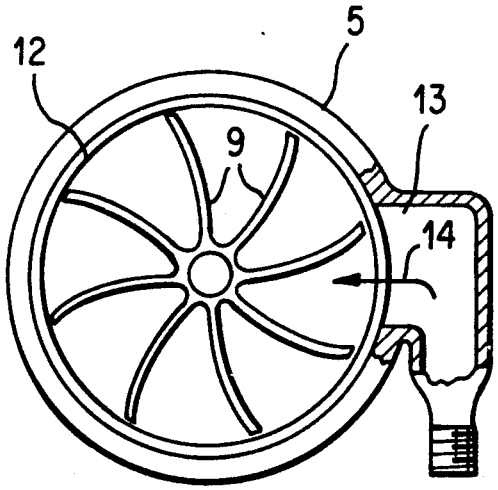
FIG. 3 PRIOR ART
FIG. 3 is a front elevational view thereof.

The state of the art in other hot water distribution systems with continuous recirculation is illustrated in FIGS. 1-3. In FIG. 1, there is shown a water heater 1 with a hot water distribution circuit comprising a pipe 2 leading to a plurality of taps 3 representing showers, tubs and sink faucets. Hot water is drawn from the distal end 4 of the hot water distribution network by a centrifugal pump and returned to a lower region of the water heater by a pipe 6 having a gauge smaller than the pipe 2 leading to the taps 3. The pump 5 is of a low throughput type protected by a check valve 7 against any backflow which may be caused when hot water is drawn at the taps. Typically, the recirculation pump 5 has a power of 40 to 50 watts sufficient to overcome the resistance of the check valve 7. The impeller and housing of a typical centrifugal pump 5 are illustrated in FIGS. 2 and 3. The driving motor and associated coupling have been omitted. The impeller 8 has a plurality of back-bent vanes 9 which when driven clockwise direct the flow of water emerging in the hub region 10 from the inlet pipe 11 toward an peripheral, annular channel 12 leading to the output port 13.

Due to the fact that calcium deposits are frequent in hot water systems, it is preferable to use a pump which does not have any close tolerance impeller bearing surface such as the type of pump disclosed in U.S. Pat. No. 3,803,432 where the impeller and rotor are suspended on a ballbearing assembly, which patent is hereby made part of this specification by reference. This last described type of pump could be damaged by backflow which occurs when the input pressure of the pump drops as water is being drawn from the taps 3. The resulting backflow illustrated by arrow 14 in FIG. 3 acts upon the curved vanes 9 of the impeller causing the pump to work as a turbine. When one considers the fact that the drop of input pressure can be up to 100 times the working pressure of the pump, one can appreciate the damage that may be caused in the fragile bearing of the recirculation pump. The check valve 7 eliminates any chance of backflow. It should be understood that if the effect of backflow could be reduced, and the check valve 7 eliminated, the power of the recirculation pump 5 could be reduced to approximately 10 watts for a typical domestic hot water installation. This will result in a substantial power saving over time.

Figure 4:
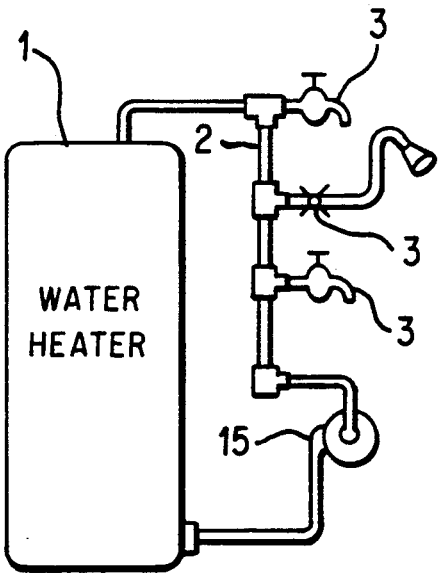
FIG. 4 illustrates the water heater distribution and recirculation unit improved in accordance with the invention.

Such an improved system is illustrated in FIG. 4 which is distinguished from the installation illustrated in FIG. 1 by the absence of the check valve 7 and the increased dimension of the output port 15.

Figure 5:
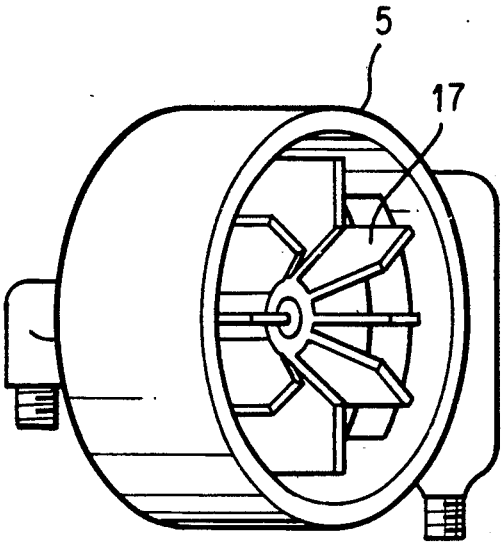
FIG. 5 is a perspective view of an improved centrifugal pump water assembly.
Figure 6:
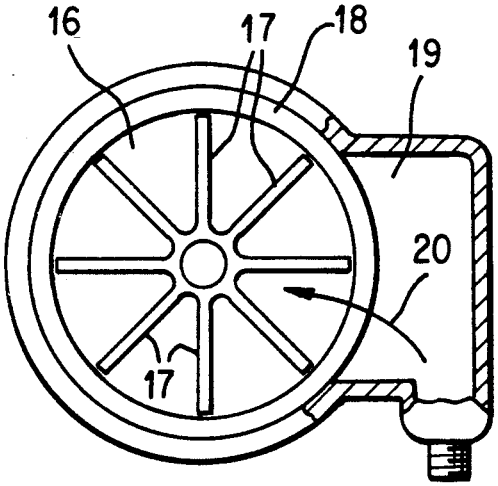
FIG. 6 is a front elevational view thereof.
Figure 7:
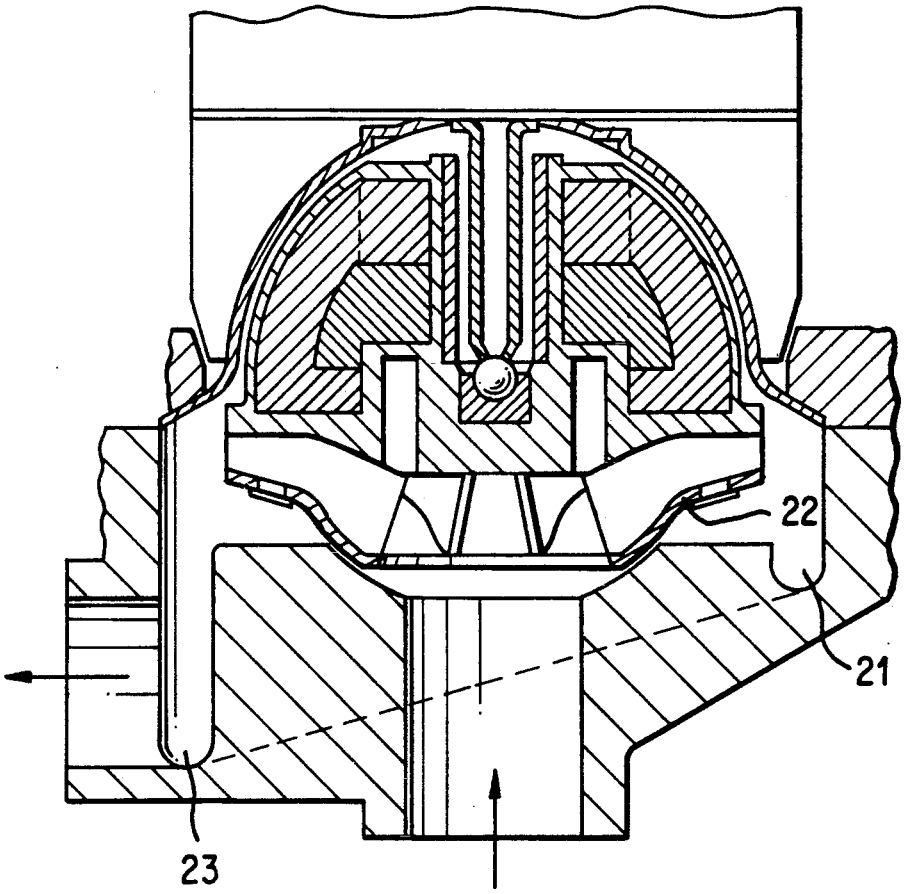
FIG. 7 shows, in sections a pump motor and impeller assembly improved according to the invention.

The pumping mechanism has been modified to limit the effect of backflow by using an impeller 16 having linear rather than bent vanes 17. More significantly the annular channel 18 has been greatly enlarged by, in the case of the embodiment illustrated in FIGS. 5 and 6, reducing the diameter of the impeller 16. The size of the output port 19 has also been increased. It can be understood that these modifications to the pump may result in a drop of efficiency and throughput. However, this drop in efficiency is largely compensated by the fact that the effect of any backflow illustrated by arrow 20 has little or no effect upon the vane 17, thus avoiding the high speed turbine action inherent to the pumps of the prior art. As illustrated in FIG. 7, the annular channel 21 surrounding the impeller 22 and the output port 23 have much enlarged cross-sections compared to the annular channel and output port illustrated in FIG. 1 of U.S. Pat. No. 3,803,432.

While the preferred embodiment of the invention has been described, modifications can be made and other embodiments can be devised without departing from the spirit of the invention and the scope of the appended claims.

What is claimed is:

1. In a plumbing installation wherein hot water is piped from a reservoir to a plurality of taps by a distribution conduit, and wherein the distal end of the conduit is connected to the reservoir through a centrifugal recirculation pump protected by a backflow-inhibiting check valve, said pump having a rotary impeller directing water from the impeller hub region toward a peripheral, annular channel leading to an outlet port, wherein said impeller is attached to the rotor of a spherical gap electrical motor, said rotor and impeller being rockingly held against a single, central ball-bearing by magnetic coupling between the rotor-driven pole ring and the driving pole ring of the motor stator, the improvement comprises:

deleting the check valve; and limiting the effect upon the pump of any backflow created by the drawing of hot water through the taps, including increasing the size of the peripheral channel.

2. The improvement of claim 1, wherein said step of limiting further comprises fitting said pump with an impeller having radially linear vanes.

3. The improvement of claim 2, wherein said step of increasing the size of the peripheral channel includes reducing the diameter of said impeller.

* * * * *